US008708714B2

(12) United States Patent
Niitsu

(10) Patent No.: US 8,708,714 B2
(45) Date of Patent: Apr. 29, 2014

(54) CAPACITIVELY COUPLED CONNECTOR FOR ELECTRONIC DEVICE

(75) Inventor: Toshihiro Niitsu, Machida (JP)

(73) Assignee: Molex Incorporated, Lisle, IL (US)

( * ) Notice: Subject to any disclaimer, the term of this patent is extended or adjusted under 35 U.S.C. 154(b) by 61 days.

(21) Appl. No.: 13/121,853

(22) PCT Filed: Sep. 30, 2009

(86) PCT No.: PCT/US2009/059078

§ 371 (c)(1),
(2), (4) Date: Jun. 10, 2011

(87) PCT Pub. No.: WO2010/039867

PCT Pub. Date: Apr. 8, 2010

(65) Prior Publication Data

US 2011/0275228 A1 Nov. 10, 2011

(30) Foreign Application Priority Data

Sep. 30, 2008 (JP) ..... 2008-255657

(51) Int. Cl.
*H01R 12/00* (2006.01)

(52) U.S. Cl.
USPC ..... 439/74; 439/660; 439/83

(58) Field of Classification Search
USPC ..... 439/70–74, 83, 660
See application file for complete search history.

(56) References Cited

U.S. PATENT DOCUMENTS 5,769,647 A * 6/1998 Tulley et al. ..... 439/144
5,791,943 A * 8/1998 Lo et al. ..... 439/676
5,921,787 A * 7/1999 Pope et al. ..... 439/74
6,575,769 B1 * 6/2003 Takeuchi et al. ..... 439/74
7,134,882 B2 * 11/2006 Iida et al. ..... 439/74
7,556,504 B2 * 7/2009 Ryu ..... 439/70
7,682,159 B2 * 3/2010 Huang et al. ..... 439/71
8,197,286 B2 * 6/2012 Larsen et al. ..... 439/620.21
2005/0009383 A1 1/2005 Okura et al.
2006/0183358 A1 * 8/2006 Iida et al. ..... 439/74
2007/0264854 A1 11/2007 Sasaki
2007/0281519 A1 12/2007 Shiroyama
2008/0057748 A1 * 3/2008 Nakata et al. ..... 439/69
2011/0189867 A1 * 8/2011 Niitsu et al. ..... 439/66

FOREIGN PATENT DOCUMENTS

EP 1 746 688 A2 1/2007
WO WO 97/24815 A1 4/1997

* cited by examiner

*Primary Examiner* — Truc Nguyen
(74) *Attorney, Agent, or Firm* — Timothy M. Morella

(57) ABSTRACT

An electrical connector is provided that includes a plug portion having an upper surface on which one electronic device is disposed, and a receptacle which is disposed on another electronic device. The plug portion has plug side contact conductors which are positioned separately from each other on a lower surface side of the plug portion. Between the plug side contact conductors which are positioned separately from each other, a capacitive coupling conductor is provided. The receptacle has a receptacle side contact conductors which are in contact with the plug side contact conductors. The plug side contact conductors and the receptacle side contact conductors have shapes corresponding to each other, and the receptacle side contact conductors retain the plug side contact conductors while the dielectric isinterposed between the capacitive coupling.

19 Claims, 13 Drawing Sheets

CAPACITIVELY COUPLED CONNECTOR FOR ELECTRONIC DEVICE

BACKGROUND OF THE INVENTION

The present invention relates to an electrical connector utilizing capacitive coupling and suitable for use with camera modules and other similar electronic devices.

Conventionally, a connector has been used for electrically connecting electronic devices including a circuit board with another circuit board or electrically connecting electronic components on the circuit board. For example, Japanese Patent Document No. JP 2006-310026 discloses a socket-style connector for receiving a camera module that has a built-in image sensor and the like and connecting the camera module to substrate such as a circuit board. In such conventional electronic devices, signal and power are transmitted by galvanic contact between two conductive terminals.

In recent years, the use of higher frequency signals in the electronic devices has prevailed, and in this context, connectors utilizing capacitive coupling are of interest. That is, a connector which is connected to two electronic devices and which has two conductors sandwiching a dielectric therebetween. In such a connector, it is necessary for the conductors and the dielectric to be held in close contact with each other in order to maintain proper transmission characteristics.

In the capacitive coupling connector, the conductors are not in contact with each other. However, in the case of providing the connector utilizing capacitive coupling in addition to the connector which has the contact terminals for transmitting power or the like, it is necessary to newly provide the connector utilizing capacitive coupling with a mechanism for ensuring close contact between the conductor and the dielectric. As a result, the number of components is increased.

The present invention is directed to a connector that overcomes the aforementioned problems.

SUMMARY OF THE INVENTION

It is therefore an object to provide an electrical connector which is capable of performing a transmission of signals and power with a reduced number of connector components.

In order to solve the above-mentioned problem, one embodiment of a connector connects two electronic devices with each other while being interposed between them and includes: a first connector member formed so that an electronic device is disposed on an upper surface side thereof and having first contact conductors provided in at least two positions and separated from each other on a lower surface side thereof; and a second connector member disposed on another electronic device and facing the lower surface of the first connecting member, and having second contact conductors which are in contact with the first contact conductors. The first connector member includes a capacitive coupling conductor positioned between the first contact conductors and it is positioned in opposition to a conductor provided on the other electronic device while having a dielectric interposed therebetween.

Furthermore, the first and second contact conductors have shapes which correspond to each other, and the first and second contact conductors reliably engage each other while the dielectric is sandwiched between the capacitive coupling conductor and the conductor on the other electronic device.

While the transmission of the power or the like can be performed through galvanic contact between the first and second contact conductors, the transmission of certain signals can be performed by way of a intermediation of the capacitive coupling conductor. Further, in the embodiment, the first and second contact conductors engage each other and retains the two connector members in place, while the dielectric is sandwiched between the capacitive coupling conductor and the conductor provided on the other electronic device. As a result, it is possible to reduce the number of components of the connector, while ensuring close contact between the conductor and the dielectric.

The capacitive coupling conductor provided in the first connector member is disposed so as to contact the dielectric, and the signals are directly transmitted from the capacitive coupling conductor is the conductor provided on the other electronic device. The dielectric may be disposed between the capacitive coupling conductor of the first coupling member and the conductor on the other electronic device. The dielectric may also be positioned between the conductor of the second coupling member and the conductor of the other electronic device. That is, both the conductor of the second connector member and the dielectric may be positioned between the conductor on the other electronic device and the capacitive coupling conductor. Yet further, the dielectric may be formed on the capacitive coupling conductor, or may be formed on the conductor of the other electronic device. In the case where the another conductor such as the conductor of the second connector member is disposed between the capacitive coupling conductor of the first connector member and the conductor on the other electronic device, the dielectric may be formed on the another conductor.

According to an aspect of the present invention, the other contact conductor may protrude toward the one contact conductor, and the one contact conductor may be formed so as to be capable of receiving the other contact conductor, and may hold the received other contact conductor. According to this aspect, with a simple structure, the one contact conductor is capable of retaining the other contact conductor. In addition, according to this aspect, the one contact conductor may be formed as an elastic member so as to elastically hold the other contact conductor. As described above, in the case where the one contact conductor is formed by an elastic member, the one contact conductor may have a pair of extending portions which extend toward a base portion side of the other contact conductor and catch the other contact conductor, and the pair of extending portions may respectively have contact portions which are pressed to the other contact conductor, and may be curved for reducing a clearance between the contact portions. With this structure, the other contact conductor can be further stably retained by the one contact conductor. In addition, as described above, in the case where the extending portions are curved for reducing the clearance between the contact portions, the other contact conductor may have a forward end portion which is thicker than the base portion of the other contact conductor. With this structure, the relative movement between the one contact conductor and the other contact conductor is further effectively restricted.

Still further, according to another aspect, the second connector member may be formed in a frame shape, and the capacitive coupling conductor may be positioned on an inside of the second connector member. According to this aspect, without the necessity of providing the conductor in the second connector member, both the capacitive coupling conductor and the conductor on the other electronic device can be in contact with the dielectric. Yet according to another aspect, a hole is provided that passes through the second connector member and the capacitive coupling conductor may be positioned on an inside of the hole. According to this aspect also, without the necessity of providing the conductor in the second connector member, both the capacitive coupling conductor and the conductor on the other electronic device can be in contact with the dielectric. According to those aspects, the dielectric may be formed on a surface of the capacitive coupling conductor. In further addition to the above, the first connector member may have a recess which extends downwardly, and the capacitive coupling conductor may be provided in a bottom plate portion which forms a bottom of the recessed portion. In this structure, it is possible to reduce the clearance between the capacitive coupling conductor and the conductor on the other contact conductor.

Yet further, according to another aspect of the present invention, the first connector member has a plurality of the first contact conductors which surround the capacitive coupling conductor on the lower surface of the first coupling member. Accordingly, the other contact conductor can be further stably retained by the one contact conductor.

These and other objects, advantages and features of the invention shall become more evident in a reading of the following detailed description.

BRIEF DESCRIPTION OF THE DRAWINGS

Throughout the course of the following detailed description, reference will be made to the following drawings in which like reference numbers identify like parts and in which.

DETAILED DESCRIPTION OF THE PREFERRED EMBODIMENT

In the following, an embodiment of the present invention is described with reference to the drawings. The electrical connector 1 is for electrically connecting the two electronic devices together while being interposed therebetween. Herein, the application of the electrical connector 1 which connects the circuit board 100 and the camera module 200 with each other while interposed therebetween is explained by way of example and it will be understood that other applications are possible. In particular, the electrical connector 1 is one which enables a transmission of low frequency signals and direct current power through galvanic contact between opposing conductors, or terminals, and which also enables transmission of high frequency signals through capacitive coupling between conductors out of contact with each other.

Figure 1:
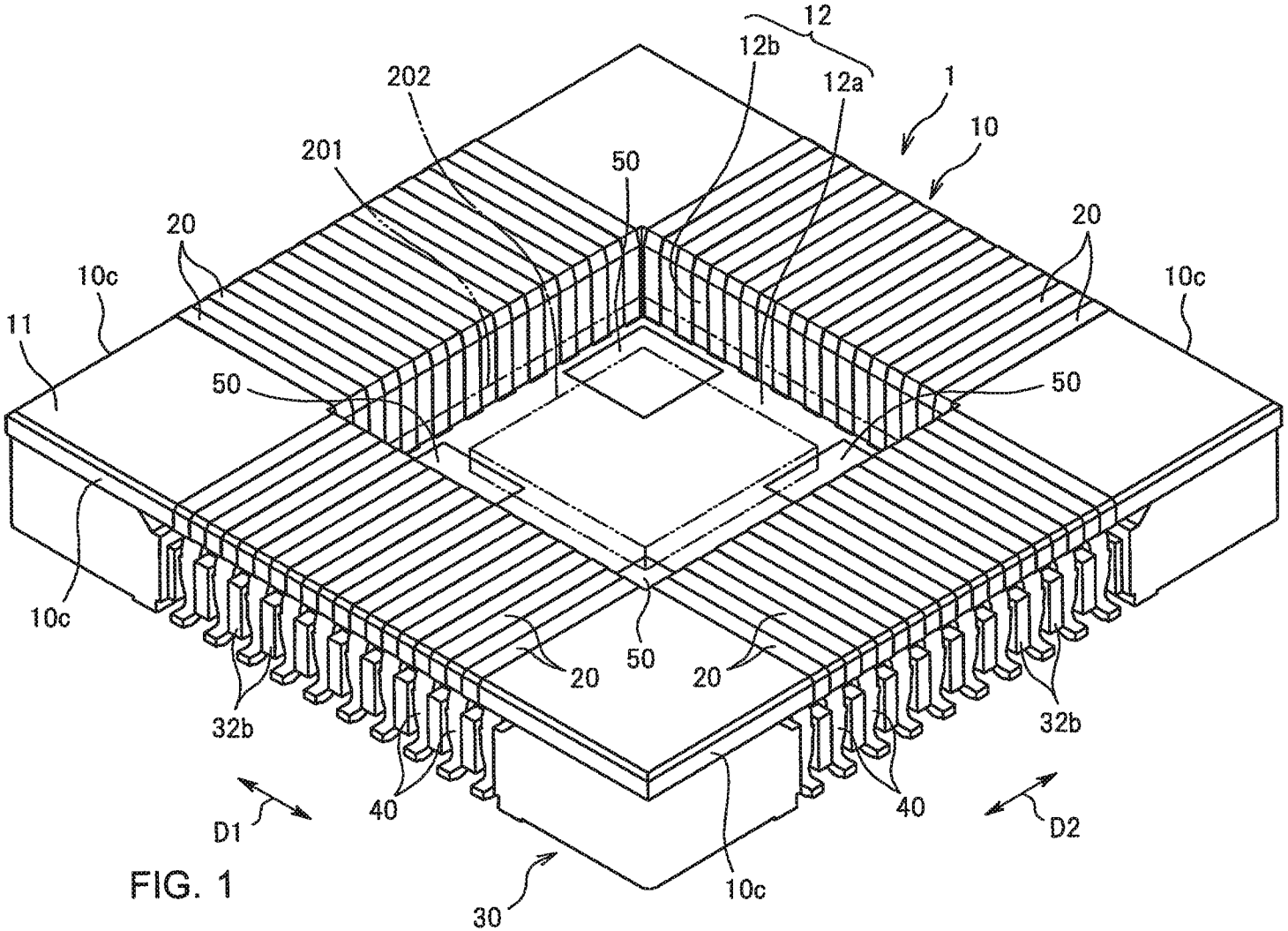
FIG. 1 is a perspective view of an electrical connector that utilizes a capacitively-coupled interface.
Figure 2:
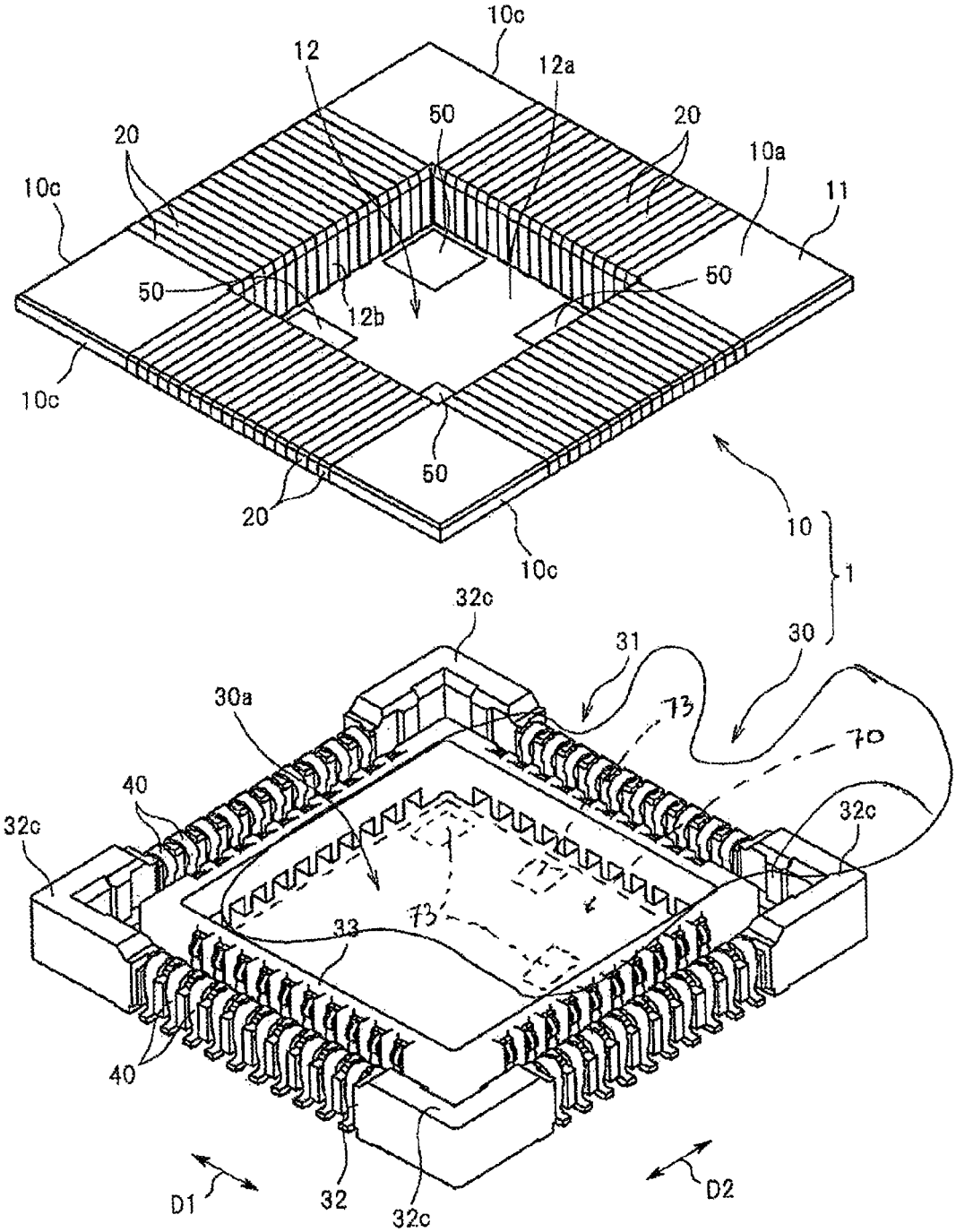
FIG. 2 is an exploded view of the connector of FIG. 1.
Figure 3:
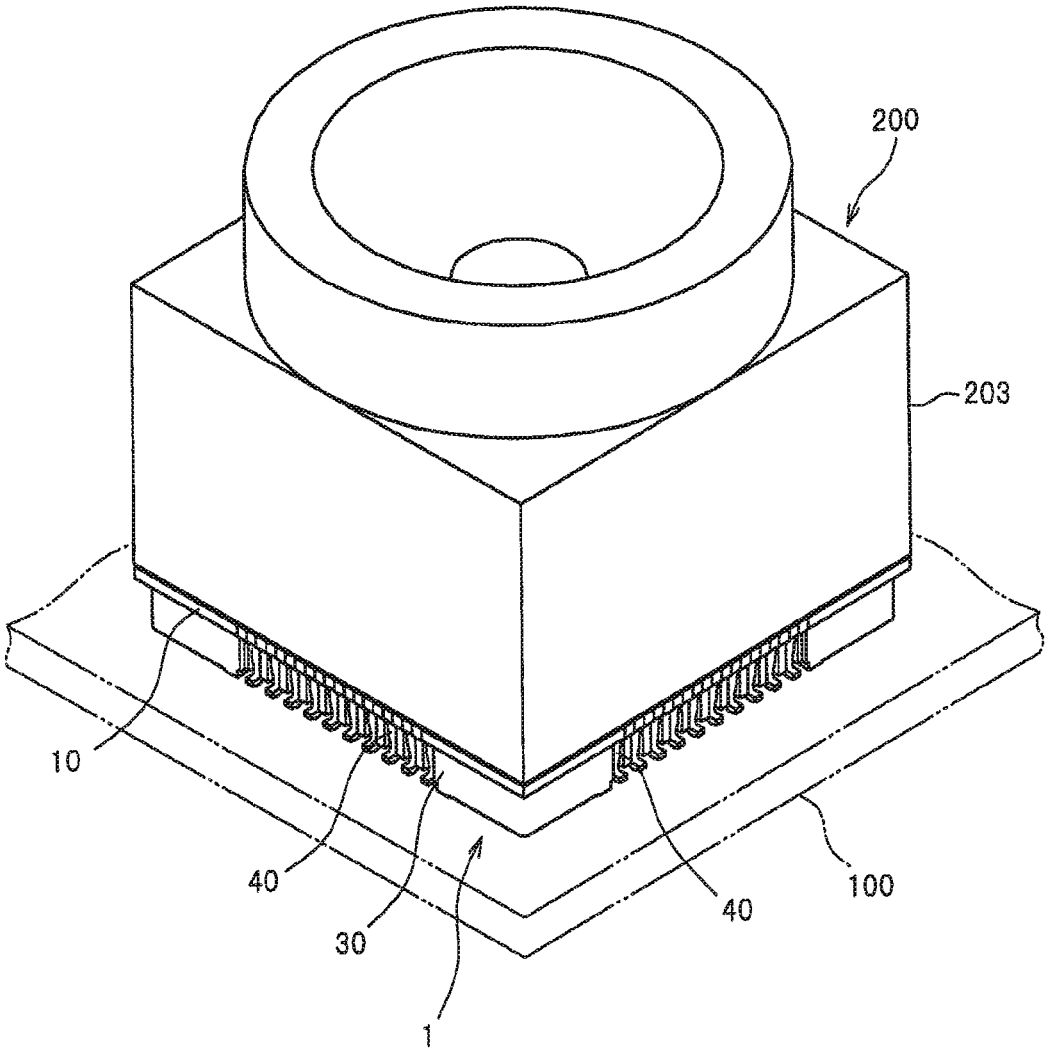
FIG. 3 is a perspective view of the connector of FIG. 1 with a camera module in place thereon, as an example of an electronic device, which is mounted on a circuit board; by way of the connector.
Figure 4:
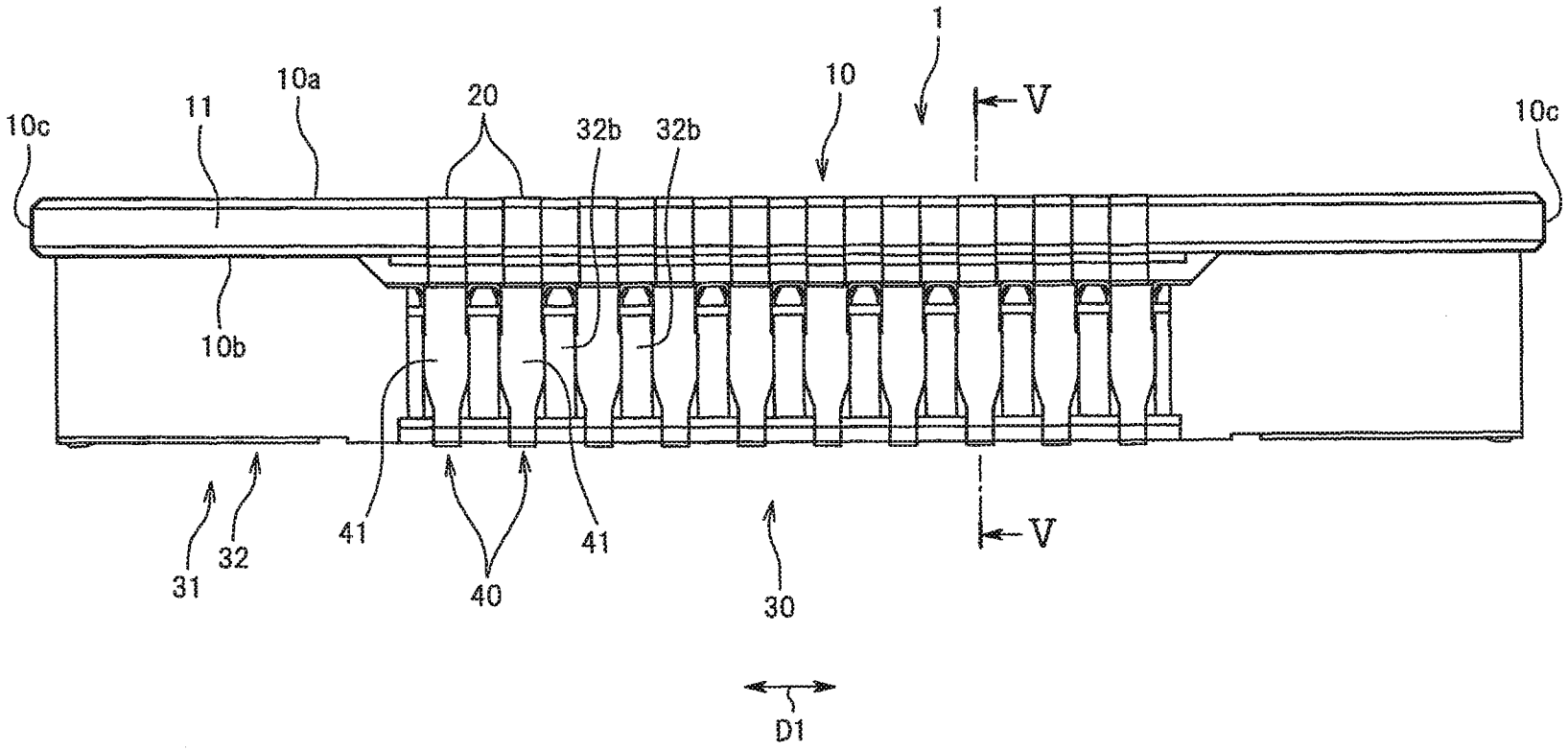
FIG. 4 is a front view of the electrical connector of FIG. 1.

The electrical connector 1 can be seen to have a plug portion, or first connector member, 10 to which a camera module 200 is attached on an upper surface 10*a* side thereof. The connector also includes a receptacle portion, or second connector member, 30 which is disposed on the circuit board 100 and disposed in opposition to a lower surface 10*b* of the plug portion 10, as shown in FIGS. 1 & 2).

Figure 5:
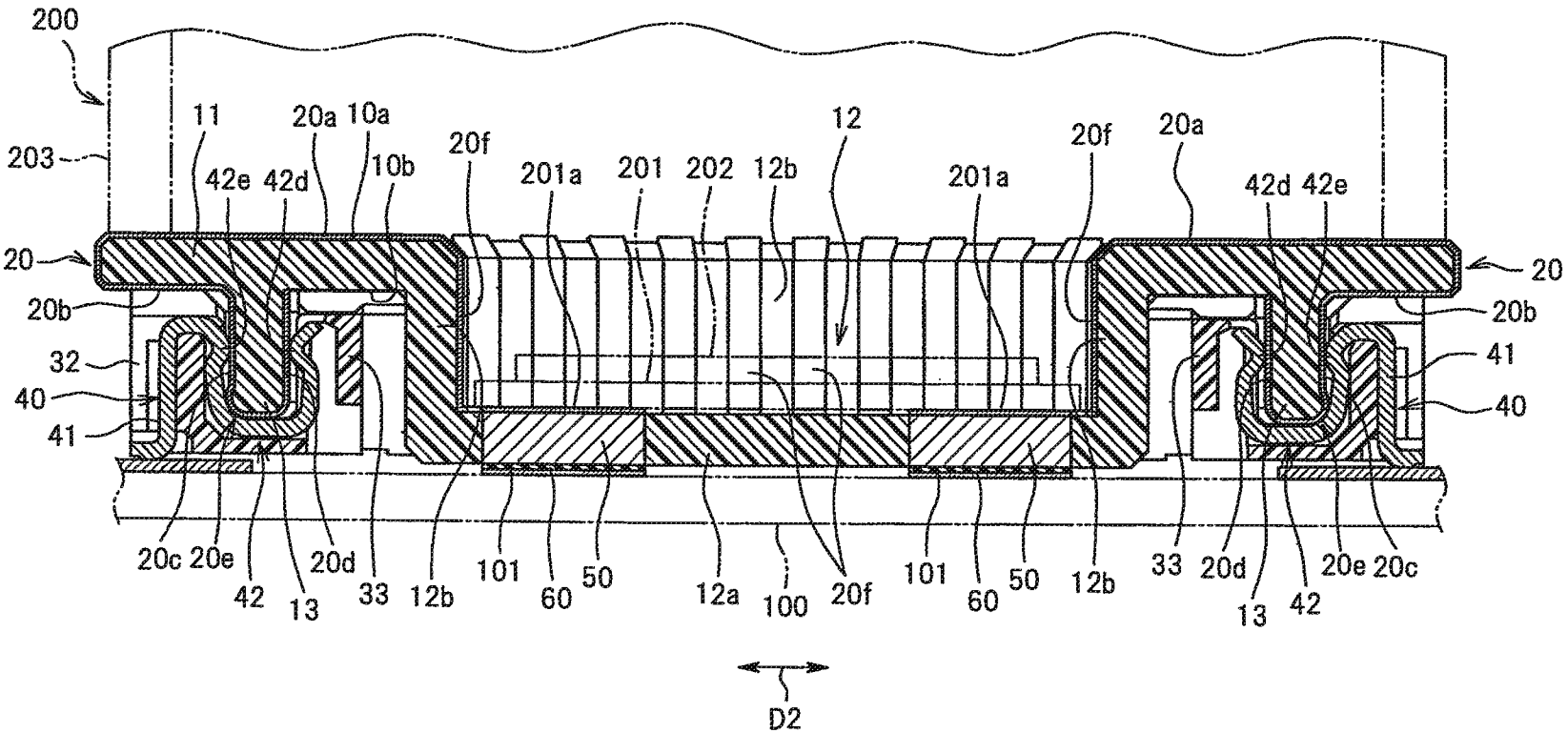
FIG. 5 is a sectional view of the electrical connector of FIG. 4, taken along line V-V thereof.

The plug portion 10 is a member preferably formed from an insulative material such as a plastic resin, and has a generally quadrangular shape, with a square shape being shown in the preferred embodiment, when taken in a top plan view. As illustrated in FIG. 5, the camera module 200 is disposed on the upper surface 10*a* of the plug portion 10. A housing 203 of the camera module 200 is attached to the upper surface 10*a* of the plug portion 10 by, for example, an adhesive. The width of the plug portion 10 is substantially equal to the width of the housing 203 of the camera module 200.

As illustrated in FIGS. 5-9, a recess 12 is formed in the plug portion 10 and the recess 12 extends recessed downwardly toward the lower surface 10*b* side. The plug portion 10 has a flat bottom plate portion 12*a* that defines the bottom of the central recess 12 and a side wall portion 12*b* extends upright from the edge of the bottom plate portion 12*a* so as to form a wall of the recess 12. In this example, the bottom plate portion 12*a* has a square shape, and four side wall portions 12*b* are upright from the edge of the bottom plate portion 12*a*. Further, the plug portion 10 has an upper plate portion 11 which expands sideward from the upper edge of the recess 12 to an edge 10*c* of the plug portion 10.

The electronic components of the camera module 200 are disposed on the inside of this recess 12. In this example, the camera module 200 includes a circuit board 201, an image sensor 202 and multiple integrated circuits (not shown) disposed on the circuit board 201. These electronic components are disposed as one element, within the interior of the recess 12, as shown best in FIG. 5. The camera module 200 also has a lens (not shown) for gathering the light incident from the outside to the image sensor 202. The lens is positioned above the image sensor 202 and is separated therefrom by the focal distance of the lens. In this example, the bottom plate portion 12*a* is formed in a square shape in conformity with the shape of the circuit board 201. However, the bottom plate portion 12*a* may be formed in a rectangular shape, a circular shape, or the like in conformity with the shape of the electronic component which is disposed on the inside of the recess 12.

Figure 6:
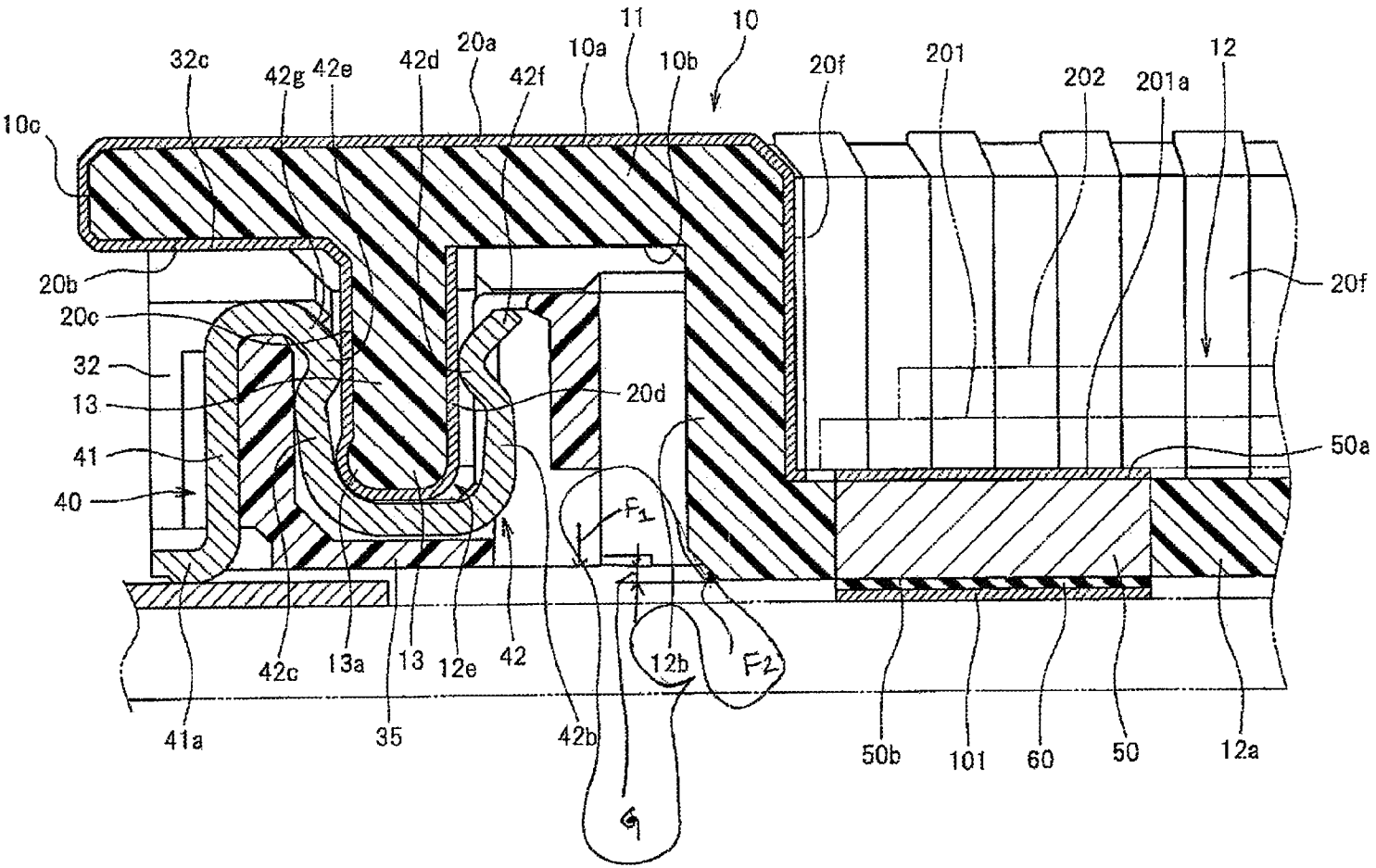
FIG. 6 is an enlarged view of the left-hand portion of FIG. 5.

As illustrated in FIGS. 2, 5 and 6, the plug portion 10 has multiple plate conductors 50 that serve as capacitive coupling conductors for the connector and which are provided on the bottom plate portion 12*a*. Four such capacitive conductors 50 are shown in the illustrated embodiment. The capacitive coupling conductors 50 are positioned in alignment with and above a conductor, or contact pad 101 that is formed on the surface of the circuit board 100. The thickness of each of the capacitive coupling conductors 50 is preferably substantially the same as the thickness of the bottom plate portion 12*a*, and a upper surface 50*a* and a lower surface 50*b* of each conductor 50 is exposed on the top and bottom above and below, respectively. The capacitive coupling conductor 50 may be formed in the bottom plate portion 12*a* by way of insert molding, for example. The capacitive coupling conductors 50 are positioned separately from each other along the bottom plate portion 12*a* of the connector, preferably in the symmetrical manner shown in FIG. 2 so as to exhibit the same shape in any of the side view and the front view thereof, and in two different directions, which are indicated by the arrows D1 and D2 of FIGS. 1 & 2. As such, the conductors 50 are preferably parallel to the four outer edges 10*c* of the plug portion 10, as well as to the edges of the plug portion bottom plate portion 12*a* and also orthogonal to each other.

The shape of the capacitive coupling conductor 50 is not limited to the plate shapes illustrated in FIG. 5 & FIG. 6. The capacitive coupling conductors 50 may also be formed by a metal film which may be formed or otherwise deposited on outer surfaces of a substrate such as insulative ceramic. In this case, the metal film is disposed on the outer surfaces of the substrate so as to enable electrical conduction between the upper surface and the lower surface of the substrate. The above-mentioned capacitive coupling conductor 50 and the substrate thereof are fixed to the bottom plate portion 12*a* by, for example, being fitted in holes formed in the bottom plate portion 12*a*.

A circuit board 201 of the camera module 200 is disposed in opposition to the bottom plate portion 12*a*. An upper surface 50*a* of the capacitive coupling conductor 50 is attached to the camera module, for example, by soldering it to a conductor 201*a* provided on the lower surface of the circuit board 201, to thereby effect an electrical connection between the camera module and the connector plug portion.

As illustrated in FIG. 6, a thin-film dielectric 60 is disposed on the lower surface 50*b* of the capacitive coupling conductor 50. The dielectric 60 is constituted by high-dielectric ceramic such as barium titanate, for example. The dielectric 60 as described above is bonded to the lower surface 50*b*, or formed in the lower surface 50*b* through sputtering.

The capacitive coupling conductor 50 and the conductor 101 on the circuit board 100 are formed at positions corresponding to each other, and the capacitive coupling conductor 50 is positioned oppositely to the circuit board conductor 101 while interposing the dielectric 60 therebetween. The receptacle portion 30 is positioned below the plug portion 10 and also has a quadrangular frame shape to match the configuration of the plug portions. The receptacle portion 30 therefore has a quadrangular cavity 30*a* which extends vertically in the central portion thereof (FIG. 2.). The size of the cavity 30*a* corresponds to the bottom plate portion 12*a* of the recess 12. Therefore, in the state in which the plug portion 10 and the receptacle portion 30 are coupled to each other, the bottom plate portion 12*a* and the side wall portion 12*b* of the recess 12 are positioned on the inside of the cavity 30*a*. (FIG. 5.) As a result, as described below, the capacitive coupling conductor 50 and the circuit board conductor 101 directly sandwich the dielectric 60 so as to effect capacitive coupling. These two conductors 50, 101 may function as a highpass filter for reducing the low-frequency noise. High-frequency signals are transmitted through the capacitive coupling conductor 50 and circuit board conductor 101. The recess 12, may, as shown in phantom in FIG. 2, include a base or floor member 70 that has one or more conductive contacts 73 supported thereby. These contacts extend through the floor member 70 and have exposed contact surfaces within the frame as shown in FIG. 2 and beneath the frame.

Figure 8:
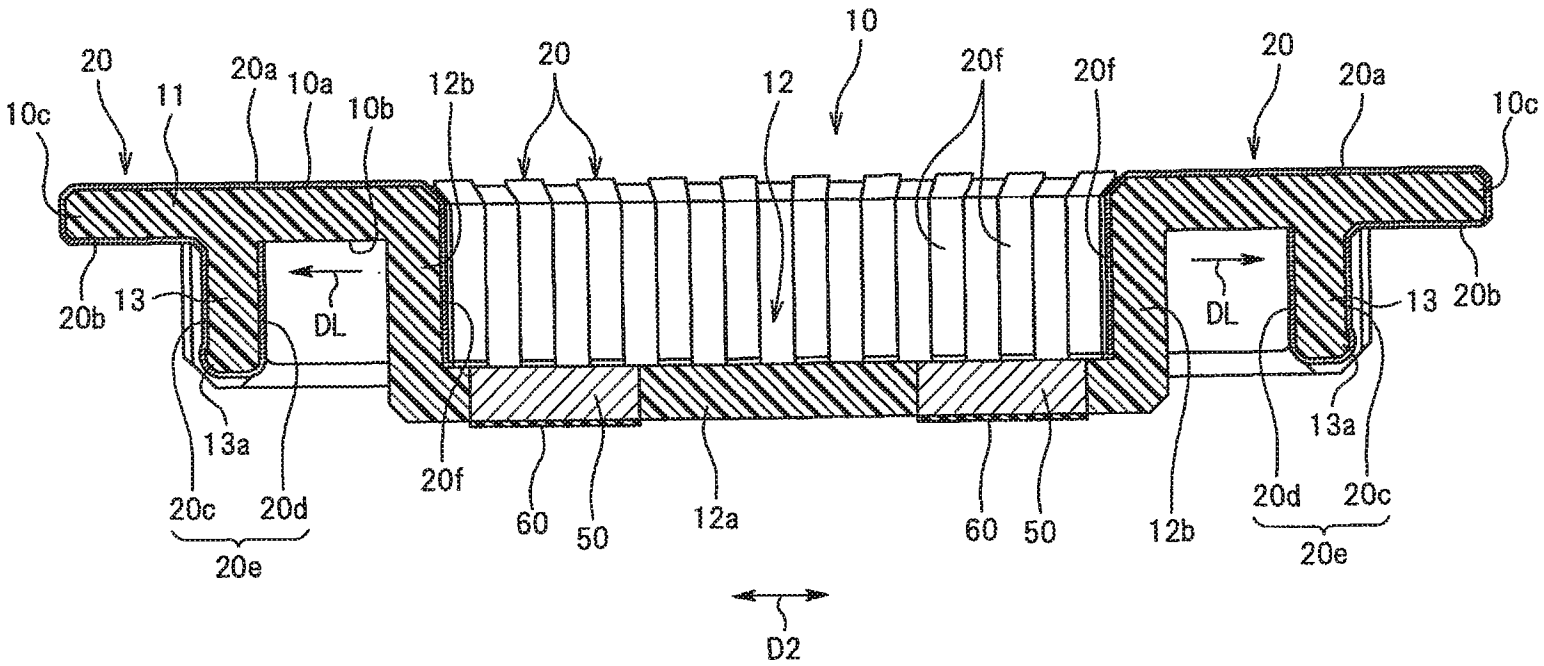
FIG. 8 is a sectional view of the connector plug portion of FIG. 7; taken along Line VIII-VIII thereof.
Figure 9:
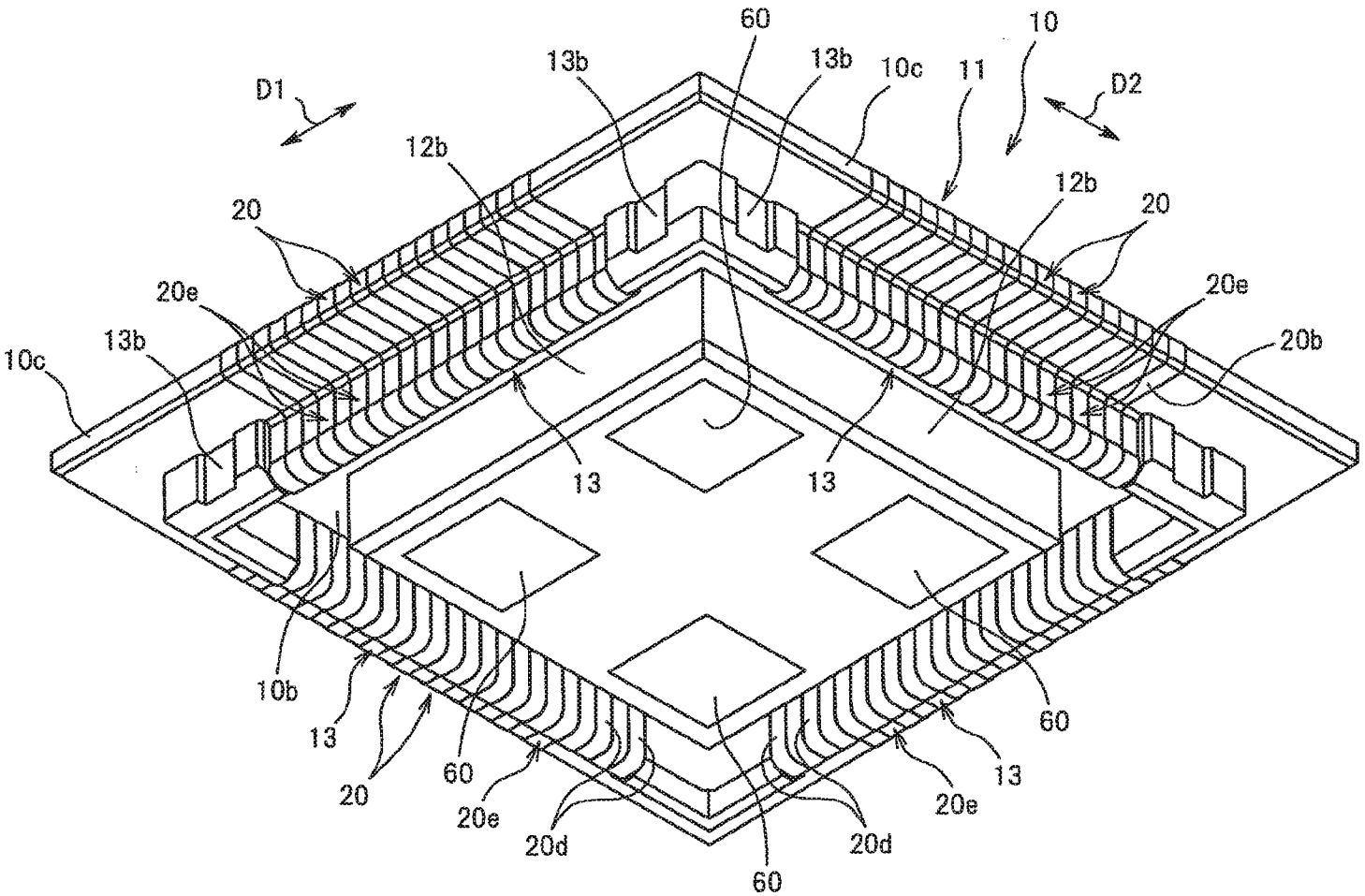
FIG. 9 is a perspective view of the connector plug portion of FIG. 7; taken from underneath and at an angle thereto.
Figure 12:
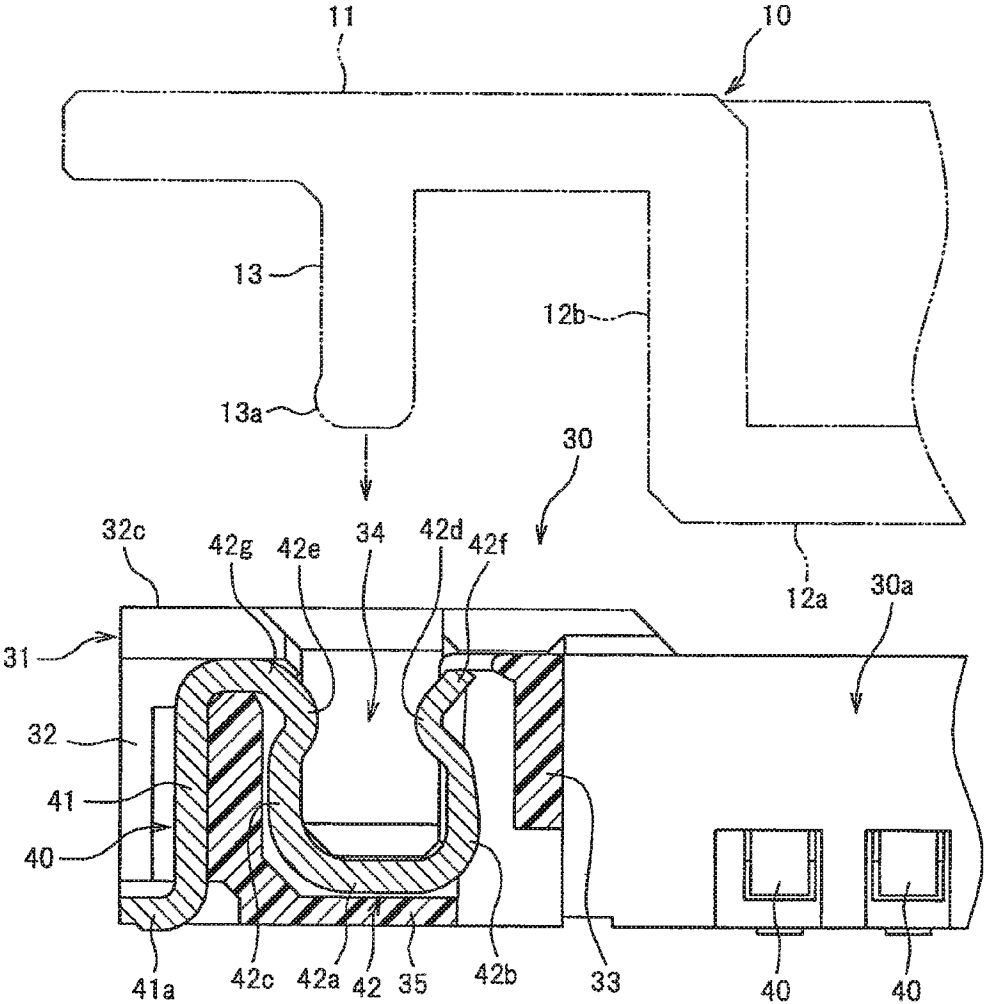
FIG. 12 is a sectional view of the connector receptacle portion of FIG. 11, taken along Line XII-XII thereof.

Further, as illustrated in FIGS. 5, 8 & 9, multiple protruding portions 13 which protrude downward are formed on the lower surface 10*b* of the plug portion 10. In an example described herein, each of the protruding portions 13 protrudes downward from the lower surface of the upper plate portion 11 so as to be spaced apart (in the direction indicated by arrow DL of FIG. 8) from the side wall portion 12*b* of the recess 12, and is preferably arranged parallel to the side wall portion 12*b*. Each protruding portion 13 extends along the side wall portion 12*b*, widthwise indicated by arrows D1 and D2, and the ends of the four protruding portions 13 are connected with each other. In this regard, the protruding portions 13 cooperatively form a quadrangular wall that surrounds the bottom plate portion 12*a* and the side wall portions 12*b*. Therefore, the protruding portions 13 positioned on opposite sides are positioned from each other, widthwise as shown and the side wall portions 12*b* are positioned each parallel pair of protruding portions 13. In this manner, the protruding portions 13 are positioned on the inner side (side wall portion 12*b* side) with respect to the edge 10*c*, and are positioned below the camera module 200 which has the same width as that of the edge 10*c* of the plug portion 10. As described later, each protruding portion 13 is engaged with the attachment channel 34 of the receptacle 30 (FIGS. 6 & 12).

The plug portion 10 may be formed as a MID (Molded Interconnect Device) in which the contacts, or terminals are directly formed in or on the surface of the molded product. As illustrated in FIGS. 1 and 7-9, the upper surface 10*a* and the lower surface 10*b* of the plug portion 10 is provided with multiple thin-film conductors 20. The conductors 20 each extend from the inside of the recess 12 to the edges 10*c* of the plug portion 10 on the upper surface of the upper plate portion 11. After that, the conductors 20 are reversed at their edges 10*c* to extend from the edges 10*c* to the protruding portions 13 on the lower surface of the upper plate portion 11. That is, each conductor 20 has an inner conductor 20*f* formed on the inner surface of the side wall portion 12*b* and contacts the terminal of the circuit board 201 disposed in the recess 12. Also, each of the conductors 20 has an upper conductor portion 20*a* formed on the upper surface of the upper plate portion 11, and a lower conductor portion 20*b* formed on the lower surface thereof.

Further, the conductor 20 is formed also on the outer surface of the protruding portion 13 which protrudes downward, and the conductor 20 has plug side contact conductor 20*e* which extends downward along the outer edges of the protruding portions 13. The plug side contact conductors 20*e* are positioned correspondingly to the positions of the receptacle side contact conductors 42 provided to the terminals 40 of the receptacle 30, and protrude downward to the receptacle side contact conductors 42 (refer to FIG. 6). The receptacle side contact conductors 42 and the plug portion side contact conductors 20*e* have shapes corresponding to each other, and the receptacle side contact conductor 42 retains respectively the plug side contact conductor 20*e*. As a result, the plug portion 10 and the receptacle 30 are reliably electrically coupled to each other. The receptacle side contact conductors 42 may correspond to one contact conductor and the plug side contact conductors 20*e* may correspond to another other contact conductor.

The multiple upper conductors 20*a* extend toward the same edge 10*c* and the lower conductor 20*b* extend from each of the upper conductors 20*a* in parallel to each other at a preselected spacing. The multiple plug portion side contact conductors 20*e* are preferably formed parallel to each other, similar to the upper conductors 20*a* and the lower conductors 20*b*, and are further arranged in the extending directions of the protruding portions 13 on the outer surface of the protruding portions 13. Thus, the multiple plug portion side contact conductors 20*e* are arranged also in a frame shape similar to the protruding portions 13 to surround the side wall portion 12*b* of the recess 12 from four sides. Further, the plug side contact conductors 20*e* formed in the two protruding portions 13 which face each other (multiple plug side contact conductors 20*e* formed on one protruding portion 13 and multiple plug side contact conductors 20*e* formed on the other protruding portion 13) are positioned separately from each other along the bottom plate portion 12*a*, and the bottom plate portion 12*a* and the capacitive coupling conductor 50 are positioned between these plug side contact conductors 20*e*.

The plug side contact conductors 20*e* are formed with pairs of plug side contact portions 20*c*, 20*d*. The plug side contact portions 20*c* extend from the lower conductors 20*b* so as to be formed on the outer surfaces of the protruding portions 13 (surfaces on edges 10*c* side). Further, the plug side contact portions 20*d* extend from the plug side contact portions 20*c* so as to be formed on the inner surfaces of the protruding portions 13 (surfaces which face side wall portions 12*b*).

Figure 10:
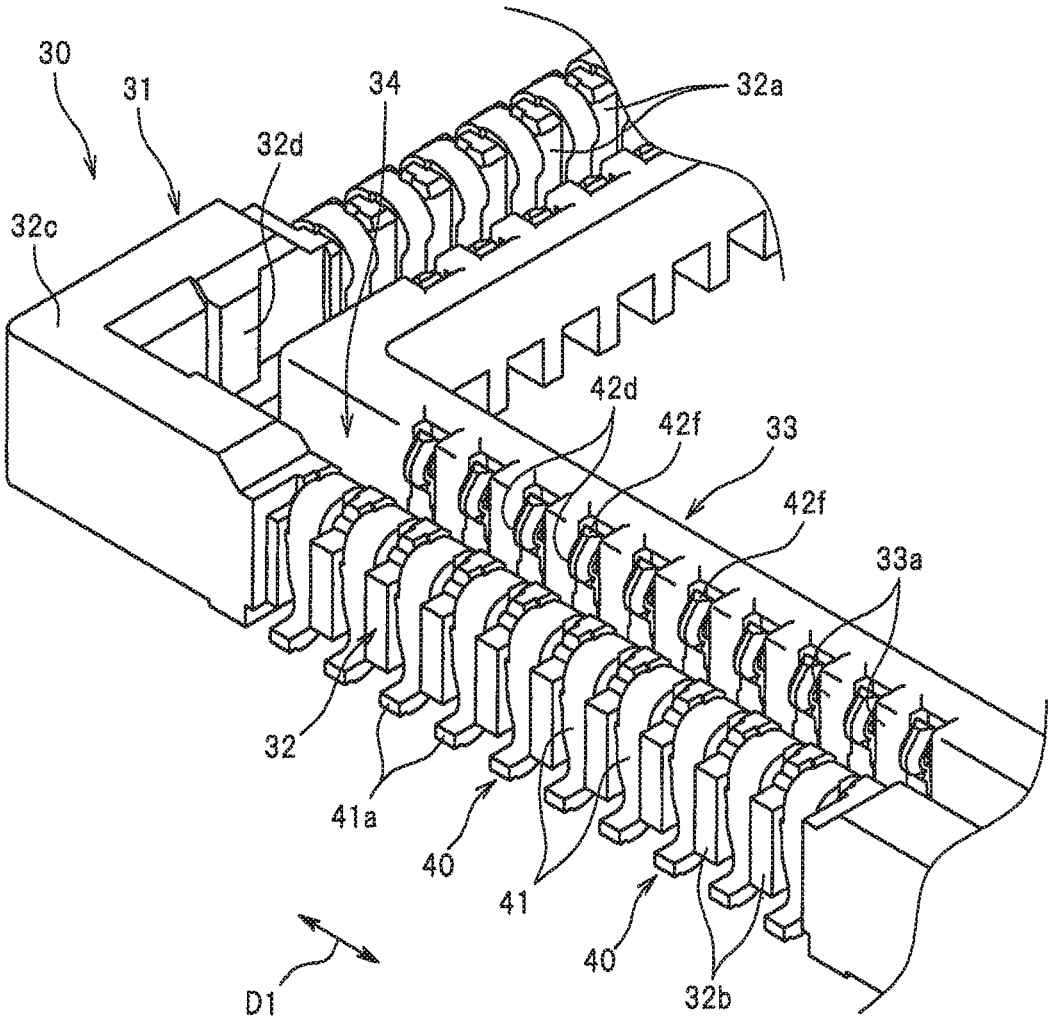
FIG. 10 is an enlarged perspective view of a corner of a receptacle portion of the connector of FIG. 1.
Figure 13:
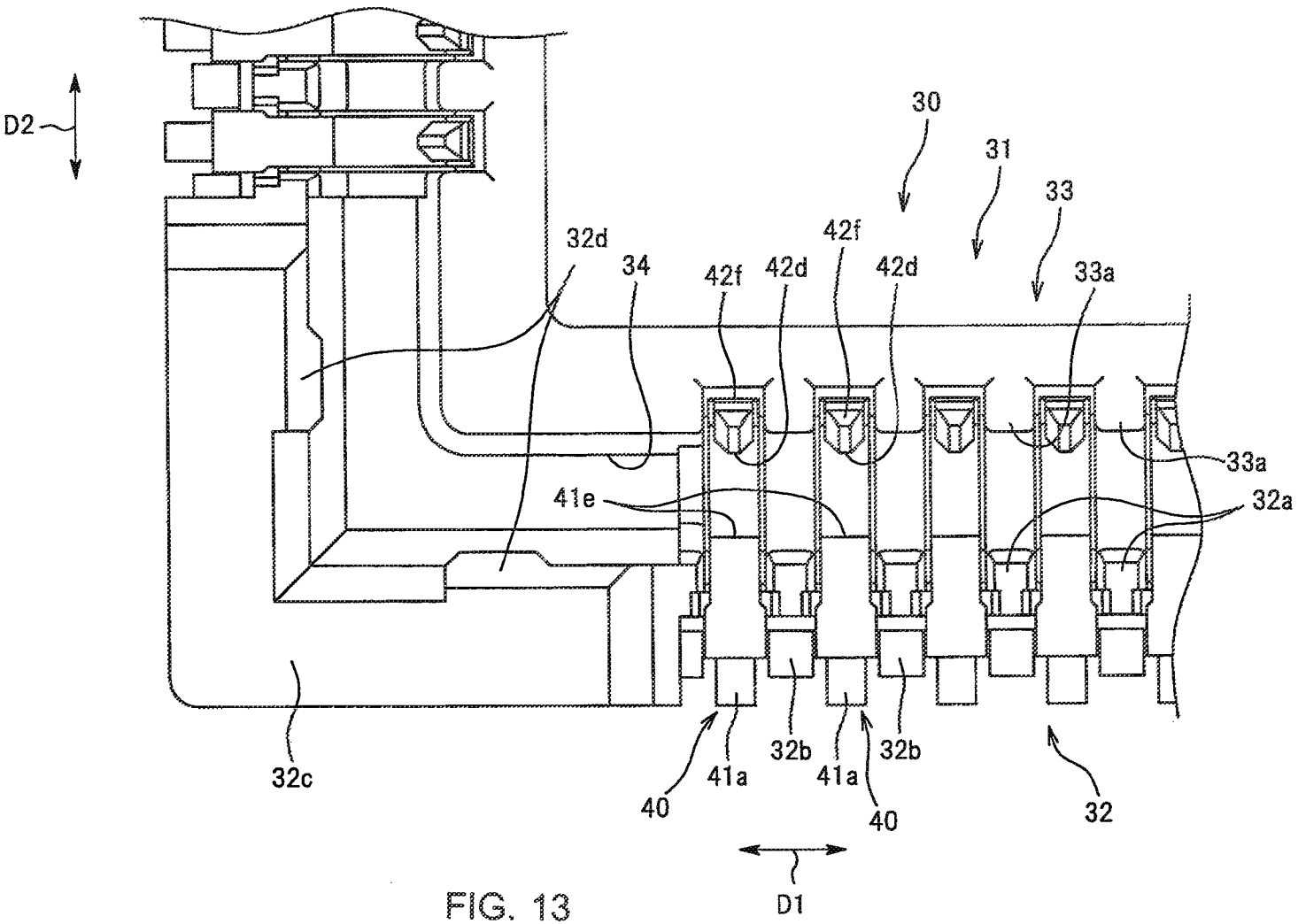
FIG. 13 is an enlarged plan view of the receptacle connector portion.

As illustrated in FIGS. 2, 10 & 13, the connector receptacle portion 30 has multiple terminals 40 and a frame 31 for retaining the terminals 40. The frame 31 is a quadrangular member formed by molding or the like. As shown, the frame 31 has a square shape similar to the bottom plate portion 12*a* of the recess 12. The frame 31 is arranged to face the lower surface of the upper plate portion 11 of the plug portion 10 in the vertical direction, and each side of the quadrangular frame 31 is arranged parallel to the side wall portions 12*b*. That is, the frame 31 surrounds the side wall portions 12*b* and the bottom plate portion 12*a*.

As illustrated in FIGS. 10, 12 & 13, the frame 31 is provided with a recess, or channel, portion 34 that extends lengthwise along each of the four sides constituting the quadrangular frame 31. Therefore, the attachment channel 34 exhibits a quadrangular groove configuration when viewed in a plan view of the frame 31. That is, the frame 31 has a quadrangular outer frame portion 32 and an inner frame portion 33 positioned inside of the outer frame portion 32, which are communicated with each other at bottom portions thereof through an intermediation of a bottom portion 35. In this context, the gap between the outer frame portion 32 and the inner frame portion 33 constitutes the attachment channel 34. The position of the attachment channel 34 which exhibits the quadrangular groove corresponding to the positions of the attachment members 13 formed in a quadrangular wall shape, which allows the attachment members 13 to be fitted in the attachment channel 34 from above (FIGS. 5-6).

Figure 11:
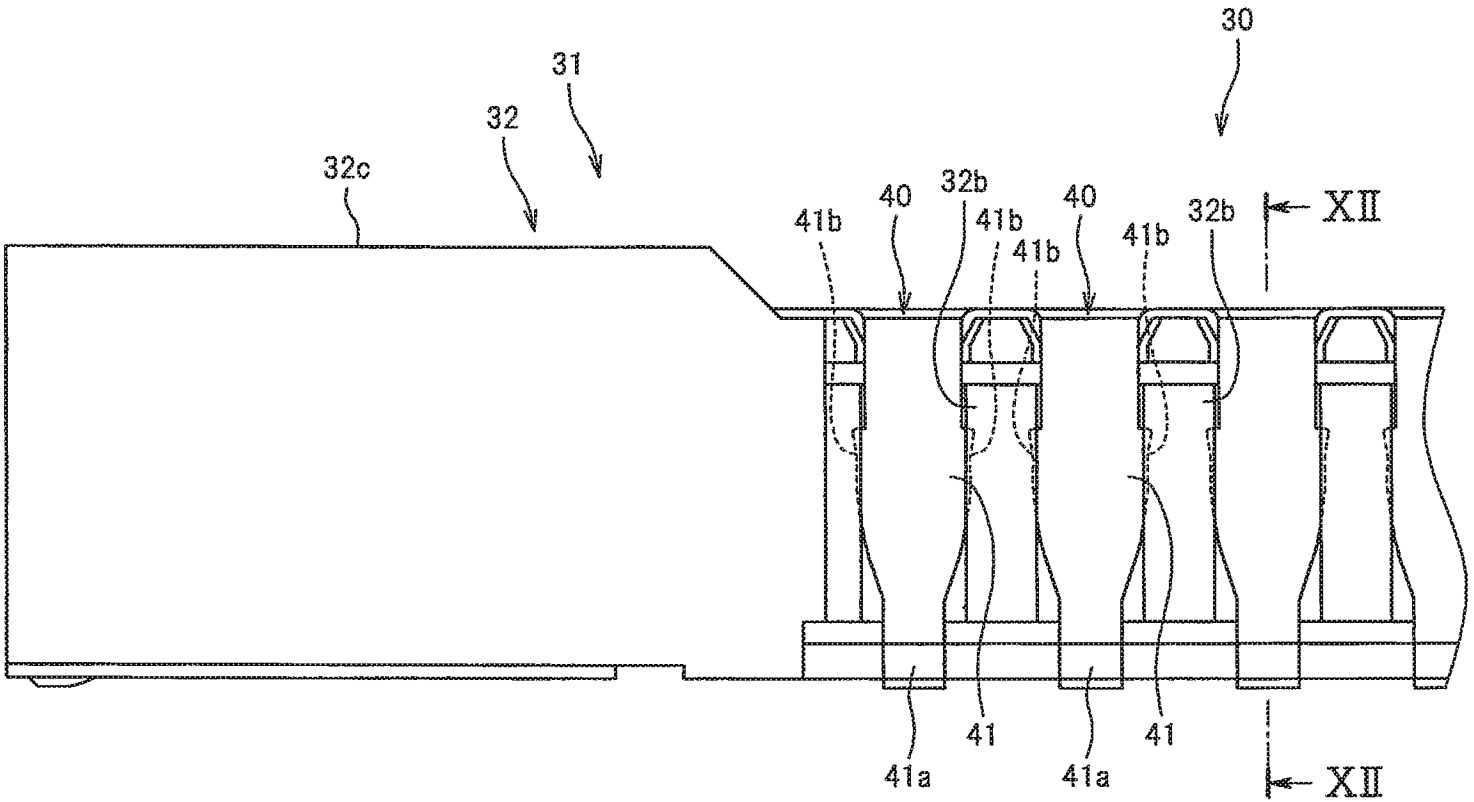
FIG. 11 is an enlarged front view of the connector receptacle portion of FIG. 10.

The terminals 40 are formed using elastic, spring materials. As illustrated in FIGS. 10, 11 & 13, the multiple terminals 40 are arranged at a certain spacing transverse to their longitudinal axes. The position of each of the terminals 40 corresponds to the positions of the conductors 20.

As described above, the terminals 40 have the receptacle side contact conductors 42 (FIG. 12). The receptacle side contact conductors 42 are positioned on the inside of the attachment recesses 34, and are formed to be capable of receiving the plug side contact conductors 20*e* which extends downward. Specifically, the receptacle side contact conductors 42 open upward (plug side contact conductors 20*e* side) so as to have substantially a U-shape. In this context, when the protruding portions 13 are fitted in the attachment channel 34, the receptacle side contact conductors 42 catch and retain the plug side contact conductors 20*e* (refer to FIG. 6). With this structure, the plug portion 10 and the receptacle 30 are reliably mated together.

The receptacle side contact conductor 42 has a bottom portion 42*a* which is disposed on a bottom portion 35 of the frame 31, and a pair of extending portions 42*b*, 42*c* which extend upward from both end of the bottom portion 42*a*. As illustrated in FIG. 10, FIG. 11, or FIG. 13, multiple wall portions 32*a*, 33*a* extending upward are formed on the inner surface of the attachment channel 34 (inner surface of outer frame portion 32 and outer surface of inner frame portion 33). The multiple wall portions 32*a*, 33*a* are arranged at intervals, and the extending portions 42*c*, 42*b* are disposed between the multiple wall portions 32*a*, 33*a*.

As illustrated in FIG. 12, the extending portions 42*b*, 42*c* have, in the upper portions thereof, a pair of receptacle side contact portions 42*d*, 42*e* facing each other, respectively. The extending portions 42*b*, 42*c* are curved toward the inside of the attachment channel 34 so that the clearance between the receptacle side contact portions 42*d*, 42*e* becomes small. In this context, as illustrated in FIG. 13, the receptacle side contact portion 42*d* protrudes to the inside of the attachment channel 34 from between the wall portions 33*a* adjacent to each other, and the receptacle side contact portion 42*e* protrudes to the inside of the attachment channel 34 from between the wall portions 32*a* adjacent to each other. Further, as illustrated in FIG. 12, the extending portions 42*b*, 42*c* have upper ends (portion above receptacle side contact portions 42*d*, 42*e*) 42*f*, 42*g*, respectively, which expand outward so as to have the clearance therebetween larger than the clearance between the receptacle side contact portions 42*d*, 42*e*.

Further, the terminals 40 have leg portions 41 which extend downward on the outside of the outer frame portion 32 from one upper end 42*g* of the receptacle side contact conductor 42 beyond the upper edge of the outer frame portion 32. At the lower ends of the leg portions 41, there are provided tail portions 41*a* to be soldered to conductors on the circuit board 100. On the outer surface of the outer frame portion 32, there are formed the multiple wall portions 32*b* which extend in the up-and-down direction and are arranged at intervals corresponding to the thickness of the leg portions 41. The leg portions 41 are arranged between the wall portions 32*b*. In this regard, as illustrated in FIG. 11, claw portions 41*b* which are hooked to the wall portions 32*b* sandwiching the leg portion 41 are formed on the side surfaces of each of the leg portions 41, the claw portions 41*b* allowing the terminals 40 to be attached to the frame 31.

Figure 7:
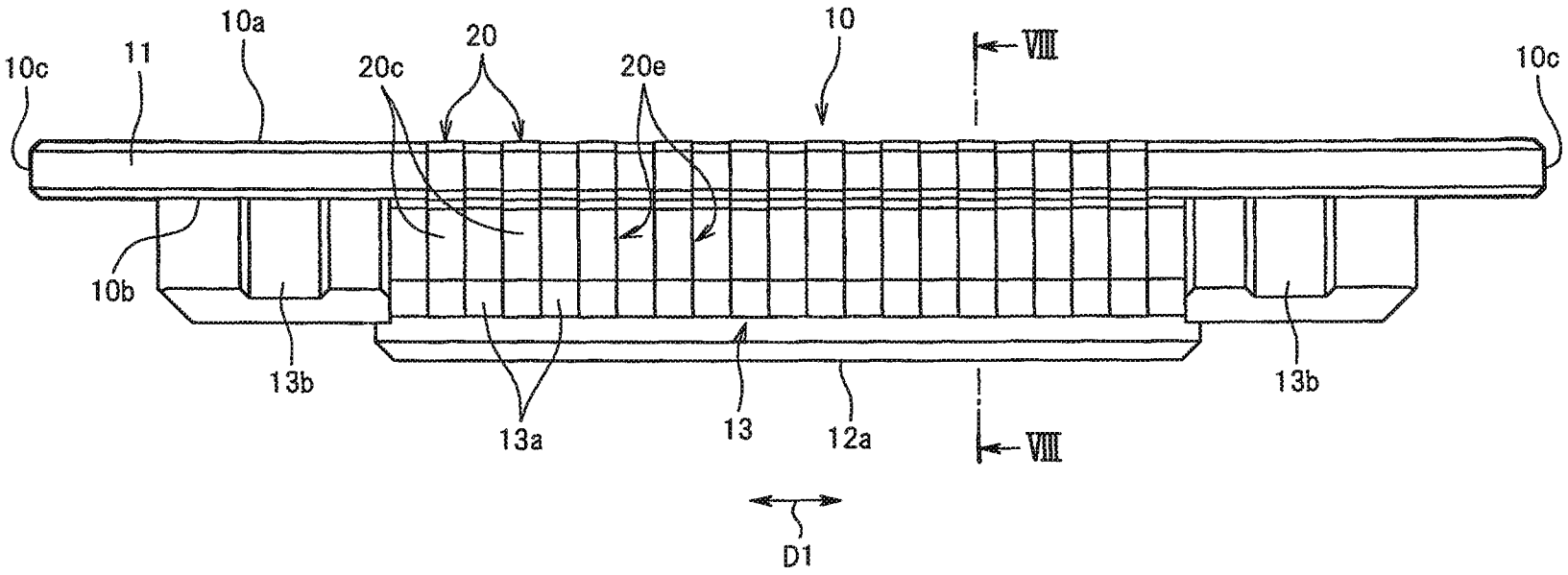
FIG. 7 is a front view of a plug portion of the electrical connector of FIG. 1.

As the attachment members 13 of the plug portion 10 enter into the attachment channel 34, the plug side contact conductors 20*e* formed on the attachment member 13 enter to the inside of the receptacle side contact conductors 42. In this case, the upper ends 42*f*, 42*g* are prevented from being collided against the plug side contact conductor 20*e* at the forward end of the attachment member 13 because the respective upper ends 42*f*, 42*g* of the extending portions 42*b*, 42*c* are widen. Further, as illustrated in FIG. 10 or FIG. 13, multiple guide protruding portions 32*d* which extend in the up-and-down direction are formed on the inner surface of the outer frame portion 32 (inner frame portion 33 side). Meanwhile, as illustrated in FIG. 7 and FIG. 9, multiple guided grooves 13*b* which extend in the vertical direction are formed on the outer surface of the attachment members 13. The positions of the guided grooves 13*b* correspond to the positions of the guide protruding portion 32*d*. Therefore, when the attachment member 13 enters the attachment channel 34, the guided grooves 13*b* are guided by the guide protruding portions 32*d*.

When the plug side contact conductors 20*e* are fitted in the receptacle side contact conductors 42, the plug side contact portions 20*c* are brought into contact with the receptacle side contact portions 42*e*, and the plug side contact portions 20*d* are brought into contact with the receptacle side contact portions 42*d*. As a result, the conductor of the circuit board 100 and the circuit board 201 disposed in the recess 12 are electrically connected with each other through contact of the conductors 20 and the terminals 40. Therefore, the conductors 20 and the terminals 40 having achieved the connection therebetween enable the transmissions of the low frequency signals and the direct current power.

As illustrated in FIGS. 5 & 6, the frame 31 has substantially the same height as the side wall portion 12*b* and preferably equal to or slightly greater (as at F1) than it so that the bottom surface F2 of the plug member is ensured of contacting the surface of the circuit board, if desired. Otherwise, in instances where it is desirable to space the bottom of the plug member from the circuit board, the height of the frame and the depth of plug recess may be modified to permit that to occur. Therefore, in the state in which the plug portion 10 and the receptacle portion 30 are mated together, the lower surface of the bottom plate portion 12*a* is positioned at substantially the same height as a lower surface 31*a* of the frame 31, thereby being proximate to the circuit board 100 compared with the upper plate portion 11.

As described above, the extending portions 42*b*, 42*c* are curved toward the inside of the attachment channel 34 so that the clearance between the receptacle side contact portions 42*d*, 42*e* becomes small. The clearance between the receptacle side contact portions 42*d*, 42*e* is smaller than the thickness (clearance between plug side contact portions 20*d*, 20*c*) of the attachment member 13, when the receptacle side contact conductors 42 having elasticity are in a free state (state of free from load). That is, the receptacle side contact portions 42*d*, 42*e* are biased to the plug side contact conductors 20*e* side (inside of attachment channel 34). Thus, in a state in which the plug side contact conductors 20*e* are positioned on the inside of the receptacle side contact conductors 42, the receptacle side contact portions 42*d*, 42*e* are laterally pressed (in a direction orthogonal to entrance direction of attachment members 13) on the plug side contact portions 20*d*, 20*c* owing to the elasticity of the terminals 40. With this structure, the receptacle side contact conductors 42 are capable of stably retaining the plug side contact conductors 20*e*. In addition, when the receptacle side contact conductors 42 retain the plug side contact conductors 20*e* as described above, the plug portion 10 is restricted from moving in the direction of being separated from the receptacle 30.

Further, as described above, the bottom plate portion 12*a* is provided with the capacitive coupling conductor 50 which has the lower surface 50*b* on which the dielectric 60 formed. The board side conductor 101 is positioned on the side opposite to the capacitive coupling conductor 50 with the dielectric 60 being interposed therebetween. Then, in this embodiment, the receptacle side contact conductors 42 retain the plug side contact conductors 20*e* while the dielectric 60 is sandwiched between the capacitive coupling conductor 50 and the board side conductor 101. With this structure, the dielectric 60 and the board side conductor 101 are brought into close contact with each other, whereby capacitive coupling is achieved between the board side conductor 101 and the capacitive coupling conductor 50. Further, the receptacle side contact conductors 42 and the plug side contact conductors 20*e* are positioned so as to surround the bottom plate portion 12*a* and the capacitive coupling conductor 50. Therefore, in the state in which the receptacle side contact conductors 42 retain the plug side contact conductors 20*e*, a part of the dielectric 60 is prevented from being separated from the board side conductor 101.

In the alternate embodiment shown in phantom in FIG. 2, the dielectric will be disposed on the bottom (mating) surfaces of the contacts 73 in the cavity 30*a* and will be pressed against a conductive contact pad exposed on the circuit board to which the connector assembly is attached. In this instance, ordinary galvanic contact will be effect between the bottom surfaces of contacts 50 and the upper surfaces of contacts 73.

As illustrated in FIGS. 2 & 10, at each of the four corner portions of the outer frame portion 32, there is formed an uppermost surface 32*c* which is slightly higher than a midway portion (portion in which terminals 40 are arranged) of each of the sides of the outer frame portion 32. The height of the frame 31 (height of uppermost surface 32*c*) and the heights of the side wall portions 12*b* (depth of recess 12) are set such that the dielectric 60 is brought into close contact with the board side conductor 101 when the plug side contact conductors 20*e* are fitted in the receptacle side contact conductors 42 so as to be retained by the receptacle side contact conductors 42.

Further, the thickness of the forward end portion 13*a* of the attachment member 13 is larger than those of the base portion and the midway portion of the attachment member 13. The forward end portion 13*a* bulges in a direction of expanding the clearance between the extending portions 42*b*, 42*c*, and has a thickness larger than the clearance between the receptacle side contact portions 42*d*, 42*e*. Therefore, after the plug portion 10 is pressed from above and the forward end portion 13*a* expands the clearance between the receptacle side contact portions 42*d*, 42*e* so as to enter the inside of the receptacle side contact conductor 42, the plug portion 10 is effectively prevented from being detached from the receptacle 30 thereafter. As a result, proper capacitive coupling is realized more effectively.

In the electrical connector 1 described above, the capacitive coupling conductors 50 are provided in addition to the plug side contact conductors 20*e* and the receptacle side contact conductors 42. Thus, while the transmission of power or the like can be performed through an intermediation of the plug side contact conductors 20*e* and the receptacle side contact conductors 42, the transmission of the high frequency signals can be performed through an intermediation of the capacitive coupling conductors 50. Further, in the electrical connector 1, the capacitive coupling conductors 50 are disposed between the plug side contact conductors 20*e* which are positioned separately from each other in the width direction of the bottom plate portion 12*a*. Therefore, the receptacle side contact conductors 42 which are positioned correspondingly to the plug side contact conductors 20*e* retain the plug side contact conductors 20*e* while the dielectric 60 is sandwiched between the capacitive coupling conductors 50 and the board side conductor 101 of the circuit board 100. In the electrical connector 1 as described above, it is possible to suppress the increase of the components for ensuring close contact between the conductor and the dielectric.

Further, in the electrical connector 1, the receptacle 30 is formed in a frame shape, and the capacitive coupling conductors 50 are positioned on the inside of the receptacle 30. With this structure, the capacitive coupling conductors 50 and the board side conductors 101 can be directly brought into contact with the dielectric bodies 60 without providing the conductor with receptacle 30.

Note that, the present invention is not limited to the electrical connector 1 described above, and various modifications can be made thereto. For example, the receptacle 30 is formed in a quadrangular frame shape in the above description. However, the shape of the receptacle 30 is not limited thereto. For example, there may be adopted a shape in which one of the four lines forming the quadrangular shape is omitted.

Further, the plug side contact conductors 20*e* are provided on the lower surface of the plug portion 10 so as to surround the capacitive coupling conductors 50 from four sides. However, the positions of the plug side contact conductors 20*e* are not limited thereto. For example, the plug side contact conductors 20*e* may be provided only at two portions with the capacitive coupling conductors 50 being sandwiched therebetween. For example, it is possible to provide the plug portion 10 with only the two attachment members 13 which are positioned on the sides opposed to each other while sandwiching the recess 12 therebetween, and to form the plug side contact conductors 20*e* on the two attachment members 13.

Further, in the above description, the dielectric bodies 60 are formed on the lower surface 50*b* of each of the capacitive coupling conductors 50. However, the dielectric bodies 60 may be formed on the board side conductor 101 of the circuit board 100.

Still further, in the above description, the receptacle 30 is formed in a quadrangular frame shape, and the cavity 30*a* is formed on the inside thereof. However, the receptacle 30 may have the bottom, and be provided with the conductors at the positions thereof corresponding to the capacitive coupling conductors 50. In addition, the dielectric may be provided on the upper surface or the lower surface of the dielectric which is provided at the bottom of the receptacle 30 in this case.

Yet further, in the above description, the camera module 200 is disposed on the upper surface 10*a* side of the plug portion 10, and the circuit board 201 on which the image sensor 202 and the like mounted is disposed on the inside of the recess 12. However, the electronic devices disposed on the upper surface 10*a* side of the plug portion 10 are not limited thereto, and various electronic devices using the high frequency signals may be disposed on the upper surface 10*a* side of the plug portion 10.

Yet further, in the above description, the receptacle side contact conductors 42 provided in the receptacle 30 retain the plug side contact conductors 20*e* provided in the plug portion 10. However, the plug side contact conductors and the receptacle side contact conductors may be formed such that the plug side contact conductor retains the receptacle side contact conductor.

Note that, the terms "up" and "down" defined in the above description refer to the directions which represent the positional relationships between the plug portion 10, the receptacle 30, and the like, and do not refer to the absolute directions.

What is claimed is:

1. A connector assembly for effecting a connection between an electronic device and a circuit board, the connector assembly comprising:

a plug portion, the plug portion including an insulative plug body, the plug body including a skirt portion and a plug member extending from the skirt portion for a preselected depth, a plurality of conductive first contacts disposed along the skirt portion and at least one conductive second contact disposed on a mating surface of the plug member, the skirt portion including at least one projecting engagement member, the mating surface facing the circuit board;

a receptacle portion mateable with the plug portion, the receptacle portion including an insulative receptacle body and an engagement channel, the receptacle body including a frame that defines and encloses a cavity in the receptacle body, the cavity having a second preselected depth for receiving the plug member therein when the plug and receptacle portions are mated together, the receptacle body including a plurality of conductive receptacle contacts disposed on the frame in opposition to the plug body first contacts , the engagement channel having a quadrangular groove configuration defined by an outer frame portion and an inner frame portion, the engagement channel receiving each projecting engagement member; and a dielectric member disposed on each plug body second contact at the mating surface to permit capacitive coupling to occur between each plug body second contact and an opposing contact disposed on the circuit board when the plug and receptacle portions are mated together.

2. The connector assembly of claim 1, wherein the plug body further includes a recess aligned with the plug member, the plug member recess extending vertically into the plug member, the plug member further including a planar plate portion that defines, on opposite surfaces thereof, a floor of the recess and the plug member mating surface.

3. The connector assembly of claim 2, where the plug body second contact includes a first surface portion disposed in the recess and facing the recess, and a second surface portion facing the circuit board.

4. The connector assembly of claim 1, further including a plurality of plug body second contacts.

5. The connector assembly of claim 1, wherein the plug body first contacts are arranged in a continuous pattern on the skirt portion and spaced apart from and surround each plug body second contact.

6. The connector assembly of claim 1, wherein the plug body first contacts are arranged in at least two distinct rows of contacts on the skirt portion and are spaced apart from each plug body second contact.

7. The connector assembly of claim 1, wherein the plug body first contacts are arranged in four distinct rows which cooperatively surround each plug body second contact.

8. The connector assembly of claim 5, wherein the plug body first contacts are disposed along each projecting engagement member.

9. The connector assembly of claim 8, wherein the plug body first contacts and the receptacle body contacts engage each other to hold the plug member in place within the receptacle body cavity.

10. The connector assembly of claim 9, wherein the plug member preselected depth is equal to or greater than the receptacle body cavity preselected depth.

11. The connector assembly of claim 10, wherein the plug body first contacts and the receptacle body contact the plug body plug member mating surface in opposing contact with the circuit board.

12. The connector assembly of claim 8, further including a pair of projecting engagement members spaced apart from and generally parallel to each other, the pair of projecting engagement members being disposed on opposite sides of the plug member.

13. The connector assembly of claim 5, further including a plurality of projecting engagement members that surround the plug member.

14. The connector assembly of claim 13, wherein the projecting engagement members are joined together to form a continuous projecting engagement member.

15. A plug connector for engaging an opposing receptacle connector, the plug connector comprising:

an insulative plug body having opposing first and second surfaces, the plug body including a flat skirt portion and a plug member projecting from the first surface, a recess formed on the second surface in alignment with the plug member and having a preselected depth, the plug member and the recess being surrounded by the skirt portion, the skirt portion including at least one attachment member projecting away from the skirt portion; and a plurality of separate first and second contacts, the first contacts being disposed on the skirt portion and the second contacts being disposed on the plug member, the second contacts including dielectric portions on exterior mating surfaces thereof for preventing galvanic contact with an opposing contact and permitting only capacitve coupling to occur with the opposing contact.

16. The plug connector of claim 15, wherein the plug member has a planar mating face spaced apart from the first surface with the second contacts are arranged in an array thereupon.

17. The plug connector of claim 15, wherein the plug body further includes at least a pair of attachment members projecting away from the skirt portion, the first contacts being supported along each attachment member.

18. The plug connector of claim 17, wherein the plug body further includes a plurality of attachment members joined together to form a continuous attachment member that surrounds the plug member.

19. A receptacle connector for engaging an opposing plug connector, the receptacle connector comprising:

an insulative connector body, the connector body including a frame portion that surrounds a hollow cavity disposed in the connector body, the cavity being at least partly defined by the frame portion and including a floor portion extending between portions of the frame, the frame portion including an engagement channel having a quadrangular groove configuration defined by an outer frame portion and an inner frame portion; and a plurality of first and second conductive contacts, the first contacts being disposed on the frame portion and the second contacts being disposed on the cavity floor portion, the second contacts including dielectric portions on mating surfaces thereof disposed along a mating face of the receptacle connector for preventing galvanic contact with an opposing contact on a circuit board in opposition to the receptacle connector.

* * * * *